United States Patent [19]

Gordini

[11] Patent Number: 4,565,060

[45] Date of Patent: Jan. 21, 1986

[54] DEVICE TO CARRY OUT DOUBLING-TWISTING OPERATIONS AND TWISTED YARN OBTAINED WITH SAID DEVICE

[75] Inventor: Dovilio Gordini, Zoagli, Italy

[73] Assignee: Officine Savio S.p.A., Pordenone, Italy

[21] Appl. No.: 705,855

[22] Filed: Feb. 27, 1985

Related U.S. Application Data

[63] Continuation of Ser. No. 489,075, Apr. 27, 1983, abandoned.

[51] Int. Cl.[4] ..... D01H 7/90; D01H 7/88

[52] U.S. Cl. ..... 57/58.3; 57/3; 57/58.36; 57/58.86

[58] Field of Search ..... 57/3, 5, 6, 12, 13, 57/58.3, 58.36, 58.52, 58.83, 58.86, 352, 354

[56] References Cited

U.S. PATENT DOCUMENTS

| | | | |
|---|---|---|---|
| 2,442,775 | 6/1948 | Nelson | 57/58.30 |
| 2,526,523 | 10/1950 | Weiss | 57/210 |
| 2,730,859 | 1/1956 | Gatling | 57/58.86 X |
| 2,901,884 | 9/1959 | Weinberger et al. | 57/224 X |
| 3,339,358 | 9/1967 | Vibber | 57/58.86 X |
| 3,397,528 | 8/1968 | Zermati | 57/58.36 |
| 3,444,677 | 5/1969 | Henry | 57/225 X |
| 3,499,277 | 3/1970 | Vibber | 57/58.83 X |
| 3,828,544 | 8/1974 | Alker | 57/224 X |
| 4,024,895 | 5/1977 | Barron | 57/210 |
| 4,225,442 | 9/1980 | Trembley et al. | 57/224 X |

FOREIGN PATENT DOCUMENTS

| | | | |
|---|---|---|---|
| 713682 | 8/1954 | United Kingdom | 57/58.36 |
| 921205 | 3/1963 | United Kingdom | 57/58.36 |

*Primary Examiner*—Donald Watkins

*Attorney, Agent, or Firm*—Stevens, Davis, Miller & Mosher

[57] ABSTRACT

A device to carry out doubling-twisting operations on yarns and to make it possible to obtain twisted yarns very resistant to the stresses of tension and also having a very even appearance comprising a limiting element to limit a balloon of the yarn, a hollow spindle, a bobbin positioned on the spindle, an axle for the spindle defining an inlet hole for entry of th yarn and a motor to rotate the axle. The product of the device is a core formed by a very thin strong supporting thread around which is wound the yarn.

5 Claims, 3 Drawing Figures

DEVICE TO CARRY OUT DOUBLING-TWISTING OPERATIONS AND TWISTED YARN OBTAINED WITH SAID DEVICE

This application is a continuation of application Ser. No. 489,075, filed Apr. 27, 1983, now abandoned.

The invention relates to a device to carry out doubling and twisting operations at the same time. More particularly, the invention relates to a device suitable for obtaining a twisted yarn which is very resistant to the stresses of tension and also has a regular appearance.

The invention also relates to obtaining twisted yarns by starting with rovings of short or very short fibers.

Devices for obtaining doubled and twisted yarn are known and consist substantially of a bobbin-bearing spindle having an axial hollow within which are made to pass the roving, or thread or yarn, to be twisted and the supporting thread withdrawn from the bobbin. The bobbin serves to feed a supporting thread to the thread to be twisted.

The roving, or thread, to be twisted usually comes from a pair of rollers and is made to pass through a yarn guide, whereas the doubled yarn reaching the outlet of the hollow spindle is made to pass through a group of rollers and is then wound onto a yarn package or other suitable means.

So as to prevent downtimes and to obviate too thick twisted yarns, the supporting thread taken from the bobbin has to last as long as possible and be as thin as possible.

For this reason a bobbin is usually employed which has a supporting thread that comprises in itself the properties of a modest circumferential size and a high mechanical strength.

Preference is normally given to a supporting thread, or yarn, of a very thin manmade type which will form a minimal percentage of the final count of the twisted yarn produced.

With the known solution and with the use of a too thin supporting thread the doubled yarn produced has a very variable appearance since the twist is imparted at the end of the hollow spindle. As a result the tract of yarn between the end of the spindle and the pair of upstream rollers is substantially saturated with twists.

This is not favorable for the final doubled yarn since the saturation of twists produced upstream causes the roving either not to be drawn or to break.

Moreover, the winding of the supporting thread taken from the bobbin tends, owing to the tension, to produce on the roving a lengthening of the pitch of its own coils without offering any resistance to the drawing.

Thus the tension tends to be discharged wholly onto the roving, which is comprised in the double yarn without an effective twist, and the resulting doubled yarn is therefore not suitable for undergoing axial tensions unless of a very limited value.

Therefore, the doubled yarn thus obtained is substantially unsatisfactory and is not fit for the purpose for which it has been made.

The invention therefore eliminates these drawbacks.

According to the invention a bobbin on a substantially hollow spindle bears a supporting thread which is of a manmade or other type but which is substantially and advantageously very strong and thin.

The supporting thread is made to pass within the hollow spindle and is united with the roving, which enters the hollow spindle below the bobbin after having undergone a controlled balloon.

With the roving entering below the bobbin and being doubled with the supporting thread taken from the bobbin itself, the supporting thread constitutes the core of the doubled yarn, while the roving is wound onto the supporting thread, thus obtaining a desired consistency in the axial direction as well. This is so because the twist on the roving is generated by the balloon and therefore has a value which decreases from the inlet hole below the bobbin up to the group of powered rollers located upstream from the device.

By applying suitably a braking action to the feed of the supporting thread as the twist generated by the intermediate yarn guide progresses, it is possible to bring about conditions wholly like those of spinning with the self-acting technique.

Next, by fixing a suitable value of tension between the upstream pair of powered rollers and the downwstream pair of powered rollers, the roving undergoes a drawing under torsion wholly like that obtained during the phase of leaving the carriage with the self-acting technique.

As is known, the self-acting technique of spinning exploits the phenomenon by which, if a given member of twists is imparted to a roving, the twists are distributed evenly only and if the roving is even; otherwise the twists are concentrated on the thinnest parts and thin out on the thicker parts.

If the twisted roving is then drawn, it will offer a resistance in its more twisted parts and will be lengthened in its less twisted parts, which are the thicker parts, as we said earlier. The final outcome will lead to a yarn of a better evenness.

This is the so-called self-acting technique of spinning, and it is well known that this technique can be applied on ly with very low drawing values and on yarns made of very short fibres where other drawing systems do not ensure enough evenness.

Thus the invention makes it possible to obtain the many foregoing advantages and others again, amongst which are the following:

a fabric made with yarn thus obtained has a better handle since the part formed by the fibers stays on the surface whereas the supporting thread remains inside;

the dyeing of yarn made in this way is better and is homogeneous in that the supporting thread stays inside and is hidden.

The invention is therefore embodied with a device to carry out doubling-twisting operations which is suitable for processing rovings or threads or carded yarns having short or very short fibers or fibres of a staple length for wool or cotton and which comprises:

means to limit the balloon of the roving, a bobbin which holds supporting thread and is positioned on a hollow spindle and is situated substantially axially to and within the balloon, rotating means with an inlet hole for entry of the roving leaving the balloon into the axle of the hollow spindle, the inlet hole being located below the bobbin.

Furthermore the invention embodies a twisted yarn which is made of rovings or threads or carded yarns having short or very short fibers or fibers of a staple length for wool or cotton and which comprises a core of very thin, strong supporting thread on which the roving is wound and twisted.

Other details and features of the invention will stand out from the description given below by way of nonlimitative example and with reference to the accompanying drawings, in which.

Figure 3:
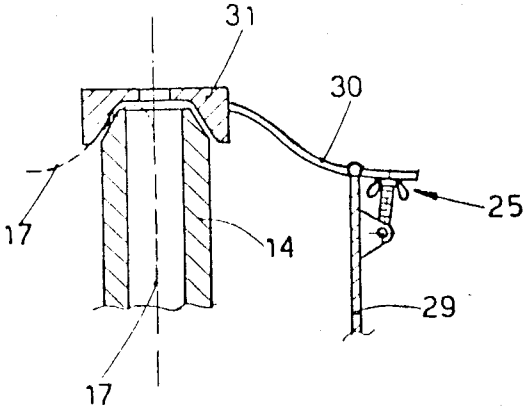
FIG. 3 shows a detail of the embodiment of FIG. 2.

In the figures a roving 10 of a type with short or very short fibers, for instance, is fed by feed rollers 11 which rotate in a direction of rotation 15.

Instead of the roving 10 there could also be a thread or yarn 10 to be twisted; the word "roving" hereinafter covers all the variables.

The roving 10 passes through a yarn guide 12 before taking up the conformation of a balloon 32.

This balloon-wise conformation 32 can be controlled by an annular guide 13 or by other means of a known kind to control the balloon.

On leaving the balloon 32 the roving 10 goes into an inlet hole 20 located in a hollow spindle 14 below a bobbin 16.

Having gone into the hollow spindle 14, the roving 10 is doubled with a supporting thread 17 taken from the bobbin 16.

The supporting thread 17 is advantageously very thin and strong.

The thread 17 can be, for example, of a manmade type and can thus comprise all the best properties as regards size and strength, but it can also be a blended type of thread or a thread of natural fibres, depending on the doubled and twisted yarn being obtained.

On arrival near the inlet hole 20 the supporting thread 17 begins cooperating with the roving 10 and is doubled therewith 10, the hollow spindle 14 being upheld by a support 18 and set in rotation according to a direction of rotation 15 by a motor 19.

A doubled and twisted yarn 23 reaches feed rollers 111 located downstream from the device and goes from the rollers 111 to a roller 22 which feeds it to a yarn package 21 or another means.

In this way twisted yarns 23 can be obtained by starting with carded yarns having short or very short fibers and by subjecting the rovings 10 to drawing, as in the so-called self-acting technique.

It is also possible to obtain twisted yarns 23 by using rovings 10 having fibers of a staple length for wool or cotton and coming from a drafting unit upstream from the feed rollers 11 upstream from the device, and to obtain in this way a very even yarn 23.

This means that it is possible to arrive at and even to surpass the present limits of the ability of the foregoing type of material to be spun without any loss of quality.

Figure 2:
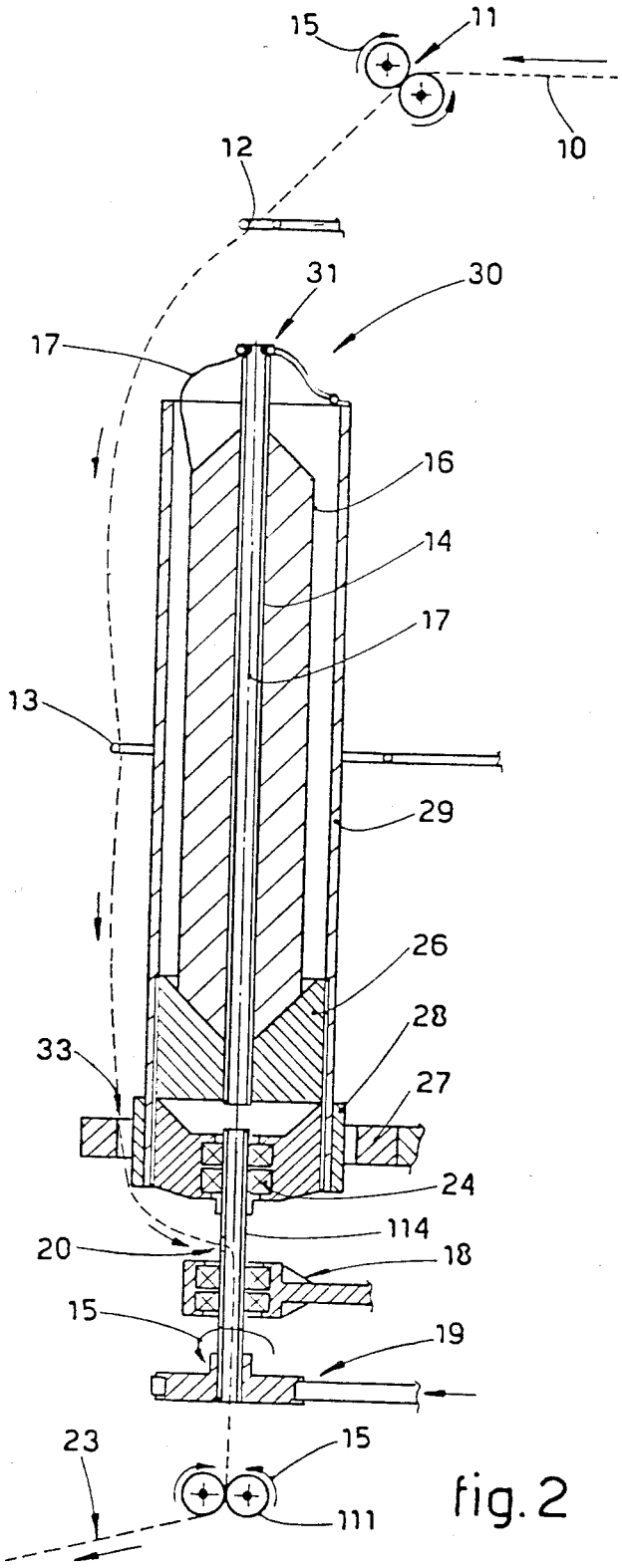
FIG. 2 shows a second embodiment of the device.

In another embodiment of the device the same twisted yarn 23 can be obtained without the need to set the bobbin 16 in rotation. This revolutionary emodiment is shown in FIG. 2, wherein a bobbin 16 that serves to feed the supporting thread 17 is sustained on a hollow spindle 14 which stays substantially still and which is upheld by an immovable support 26 that may possibly cooperate with a container 29.

The immovable support 26 is kept in position by the cooperation of cooperation bodies 28 with magnet means 27, whereby between the magnet means 27 and the cooperation bodies 28 there is an annular chamber 33 through which the balloon 32 can pass freely before going into the hole 20.

The twisting action is obtained once more by the cooperation of a rotatable element, here a bored rotatable support 114, set in rotation by the motor 19 and sustaining the immovable support 26 owing to bearings 24.

Thus, while the bored rotatable support 114 is set in rotation in the direction 15, owing to the cooperation of the cooperation bodies 28 with the magnet means 27 the immovable support 26 that bears the hollow spindle 14 stays substantially suspended and still.

It is possible to utilize brakes on the supporting thread 17 so as to improve cooperation between the roving 10 and thread 17 being doubled.

The brakes can be, for example, of the type shown in FIG. 3, wherein the hollow spindle 14 has at its end a shape so as to conform with friction means 31.

The supporting thread 17 passes between the friction means 31 and the end zone of the hollow spindle 14. The friction exerted by the means 31 on the thread 17 is regulated by an elastic means 30 which advantageously has an adjustable pressure.

The pressure of the friction means 31 can be graduated, for instance, by acting on a suitable pressure regulating means 25, which cooperates with the elastic deformation that may be accepted by the elastic means 30.

Figure 1:
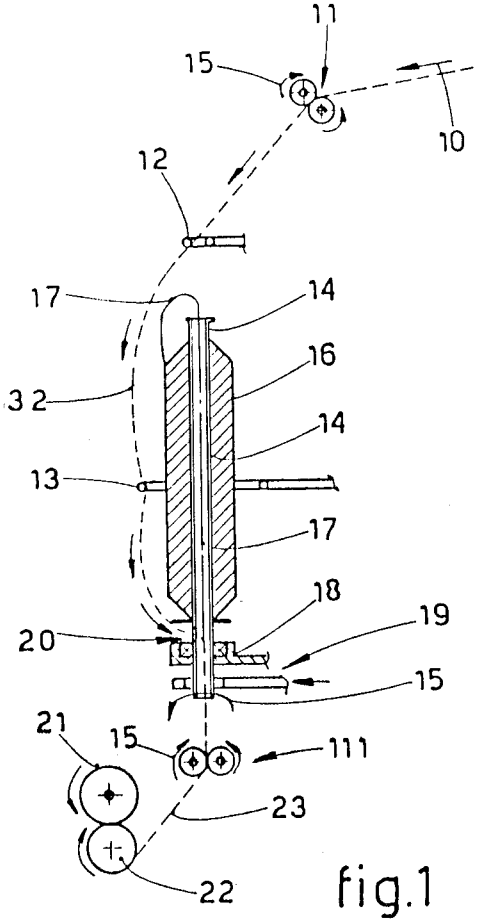
FIG. 1 shows a first embodiment of the device.

In the embodiment of FIG. 2, the roving 10 follows the same path as in FIG. 1, but the supporting thread 17 leaves a bobbin 16 kept substantially still, is braked by friction means 31, goes into an immovable hollow spindle 14 and is doubled near the inlet hole 20 with roving coming in through the inlet hole 20.

With the device it is possible to obtain a twisted yarn 23 having a core of very thin, strong supporting thread or yarn 17 of a manmade type, for instance, whether multifilament or monofilament, onto which is wound a yarn 10 in cylindrical twisted coils, which is consistent under tension owing to the inclusion of this inner core.

The twisted yarn 23 in question also has good regularity in terms of its formation. The color of the supporting thread or yarn 17 can be the same as or different from that of the outer yarn.

Instead of friction means 31 located in cooperation with the end of the hollow spindle 14, friction means can also cooperate with the inside of the hollow spindle 14 and with means to regulate friction and as being of a piston type or bead-wise or sphere-wise.

I claim:

1. Device for doubling-twisting material selected from rovings, threads, carded yarns having short fibers, carded yarns having very short fibers, fibers of a staple length for wool and fibers of a staple length for cotton comprising:

means to limit a balloon of the material;

a hollow spindle;

a bobbin which holds a supporting thread surrounding said hollow spindle within which the supporting thread is made to pass, the bobbin being situated substantially axially to and within the balloon;

an axle for the spindle defining an inlet hole for entry of said material leaving the balloons, the inlet hole being located below the bobbin, rotating means for said axle and friction means positioned over the top of said spindle to control the passage of the supporting thread into said spindle.

2. The device of claim 1, including feed rollers upstream and downstream of said bobbin.

3. The device of claim 1 or 2, whereby the bobbin is positioned on the axle for the spindle and can rotate.

4. The device of claim 1 or 2, whereby the bobbin is fixed and does not rotate.

5. The device of claim 1 or 2, whereby at least part of the hollow spindle can rotate.

* * * * *